United States Patent [19]

Naruse et al.

[11] Patent Number: 4,933,215

[45] Date of Patent: Jun. 12, 1990

[54] METHOD AND APPARATUS FOR COATING WEBS

[75] Inventors: Yasuhito Naruse; Nobuyoshi Kaneko, both of Shizuoka, Japan

[73] Assignee: Fuji Photo Film Co., Ltd., Kanagawa, Japan

[21] Appl. No.: 315,180

[22] Filed: Feb. 27, 1989

Related U.S. Application Data

[63] Continuation of Ser. No. 82,460, Aug. 7, 1987, abandoned.

[30] Foreign Application Priority Data

Aug. 7, 1986 [JP] Japan ..... 184323

[51] Int. Cl.[5] ..... B05D 1/30

[52] U.S. Cl. ..... 427/420; 118/70; 118/410; 118/411; 118/DIG. 4

[58] Field of Search ..... 118/70, DIG. 4, 410, 118/411; 427/420

[56] References Cited

U.S. PATENT DOCUMENTS

| | | | |
|---|---|---|---|
| 2,155,083 | 4/1939 | Drewsen | 118/70 X |
| 2,239,383 | 4/1941 | Drewsen | 118/70 |
| 2,899,339 | 8/1959 | Rakus | 117/102 |
| 3,739,745 | 6/1973 | Turpin | 118/70 X |
| 3,759,220 | 9/1973 | Saito et al. | 118/102 X |
| 4,099,393 | 7/1978 | Norris et al. | 118/70 |
| 4,197,812 | 4/1980 | Clayton | 118/DIG. 4 X |

FOREIGN PATENT DOCUMENTS

| | | |
|---|---|---|
| 56-73579 | 6/1981 | Japan . |
| 60-44076 | 3/1985 | Japan . |
| 60-75354 | 4/1985 | Japan . |
| 2103961 | 3/1983 | United Kingdom . |

*Primary Examiner*—Shrive Beck

*Attorney, Agent, or Firm*—Sughrue, Mion, Zinn, Macpeak & Seas

[57] ABSTRACT

A coating method and apparatus in which a freely falling film of a coating solution is applied to a web moving along a continuously rotating backing roll. The film width is wider than that of the web. The coating solution is removed from the backing roll by a cleansing device such as one that applies a solvent to the backing roll and then suctions the solvent and coating solution from the backing roll.

7 Claims, 2 Drawing Sheets

METHOD AND APPARATUS FOR COATING WEBS

This is a continuation of application Ser. No. 07/082,460, filed 8/7/87, and now abandoned.

BACKGROUND OF THE INVENTION

1. Field of the Invention

The present invention relates to an improvement in a process of applying a liquid coating composition to a continuously moving long flexible support, hereinafter referred to as "web". This process is used in manufacturing photosensitive or photoengraving materials, such as photographic film, photographic printing paper, and the like, magnetic recording materials, such as magnetic recording tape and the like, or recording materials, such as pressure-sensitive recording paper, thermosensitive recording paper and the like. More particularly, the invention relates to a coating method and apparatus for applying a freely falling coating composition to a web which is continuously moving on a backing roll.

2. Background of the Invention

In a conventional coating process, a thicker region of the coating film is formed at widthwise edges of a web due to the interfacial tension of the coating composition. The thicker coating film portion at the edges of the web causes irregularity of dryness in a drying process after coating. Therefore, it has been desired to remove the thicker coating film portion before a drying process. A method and apparatus improved in such a process has been disclosed in U.S. Pat. No. 2,899,339. Apparatus of this patent comprises a vacuum nozzle having a chamber within, means for connecting the nozzle with a source of vacuum, an opening in the nozzle, means for introducing into the chamber adjacent said opening a diluent for the coating, and means for guiding the nozzle against a lateral edge of the moving web with the opening positioned over the lateral edge.

Further, a method for producing a coating has been proposed in Japanese Unexamined Patent Publication No. 73579/1981. According to this reference, a liquid is jetted to a thicker coating film portion from the center portion of a function nozzle having the same double pipe structure as described. Then the liquid is sucked into the suction nozzle together with a coating composition at the thicker coating film portion.

Further, a method has been proposed in Japanese Unexamined Patent Publication No. 75354/1985 by the same inventors as those of this application. According to this reference, thicker coating portions at the edges of a coating layer are removed by an endless belt.

However, after the investigation of the coating process disclosed in the U.S. Pat. No. 2,899,339, the inventors of this application have found that it is difficult to keep a balance between the jetted solution or jet stream of the diluted solute and solvent supplied to the end portion of the suction nozzle and the suction force of the center portion of the nozzle. Accordingly, the treatment for the edges of the web is insufficient. Further, the method disclosed in the Japanese Patent Unexamined Publication No. 73579/1981 has a disadvantage in that the liquid jetted from the center portion of the suction nozzle having the double pipe structure becomes attached to the rear surface of the web, that is, the surface opposite to the surface of the web to which the coating composition is applied. Another disadvantage is that pass rollers in the vicinity of the web are stained by the liquid.

Furthermore, the method disclosed in the Japanese Patent Unexamined Publication No. 75354/1985 has an advantage in that a good coating can be made without producing a thicker coating at the edge of the web, but it has an disadvantage in that equipment relevant to the endless belt is large-scaled.

SUMMARY OF THE INVENTION

An object of the present invention is to eliminate the disadvantages in the prior art.

A particular object of the invention is to provide a coating method and apparatus in which conditions to prevent the staining of the rear surface and surroundings of a web can be easily established and in which coating can be applied uniformly over the entire widthwise length of the web without causing any thicker coating portion at the edges of the web.

In order to attain the foregoing objects, according to an aspect of the present invention, the coating method applies a freely falling coating composition film to a web continuously moving on a backing roll. The method includes the step of applying the freely falling coating composition film to the web and to ends of the backing roll. The backing roll larger in width than the film and the film larger in width than the web. The method further includes the step of removing the coating composition film from the backing roll while the application of the freely falling coating composition film is being preformed.

According to another aspect of the present invention, the coating apparatus comprises means for forming a freely falling coating composition film, a backing roll on which the freely falling coating composition film is applied to a web continuously moving on the backing roll, and cleansing means provided under the backing roll and provide with cleansing liquid spray slots and cleansing liquid suction slots.

BRIEF DESCRIPTION OF THE DRAWINGS

The above and other objects, features and advantages of the present invention will appear more fully from the following description in conjunction with the accompanying drawings, in which.

DETAILED DESCRIPTION OF THE PREFERRED EMBODIMENTS

Figure 1:
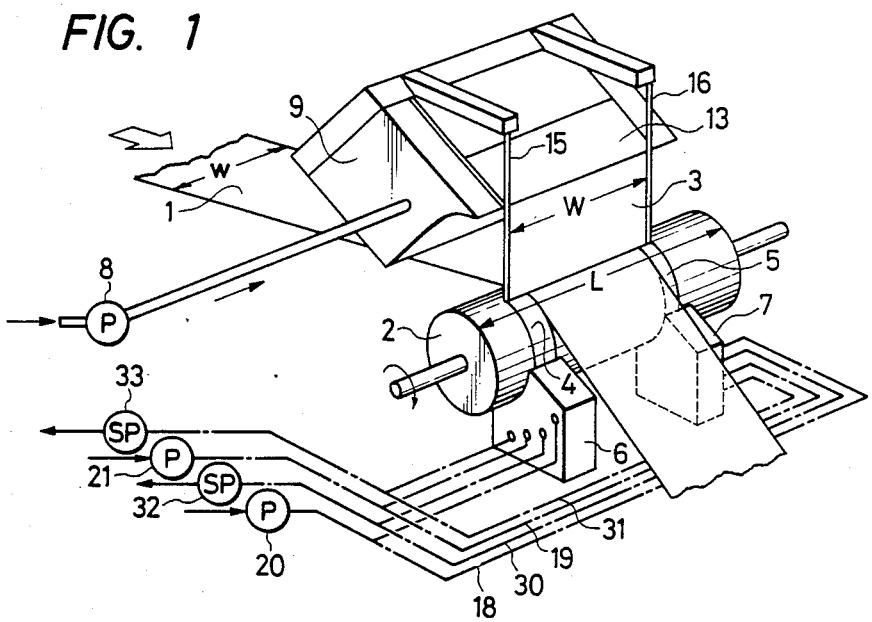
FIG. 1 is a perspective view showing an embodiment of the present invention.
Figure 2:
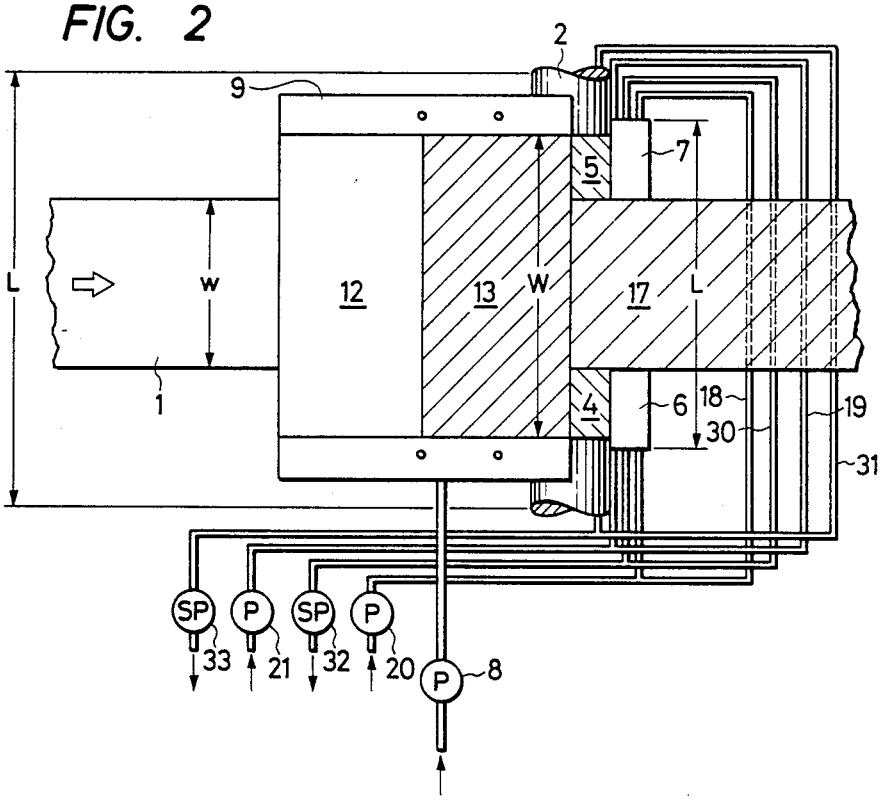
FIG. 2 is a plan view thereof.

FIGS. 1 and 2 illustrate a coating method according to the present invention for applying a freely falling coating composition film 3 onto a web 1 continuously moving on a rotating backing roll 2. The freely falling coating composition film 3 is applied to the web 1 and to lateral ends of the backing roll 2 having a length L which is larger than a width W of the freely falling coating composition film 3. The width W of the film 3 is selected to be larger than a width w of the web 1. The application of the coating composition film 3 is carried out while cleansing apparatus 6 and 7 remove coating composition parts 4 and 5 applied on the backing roll 2.

Figure 3:
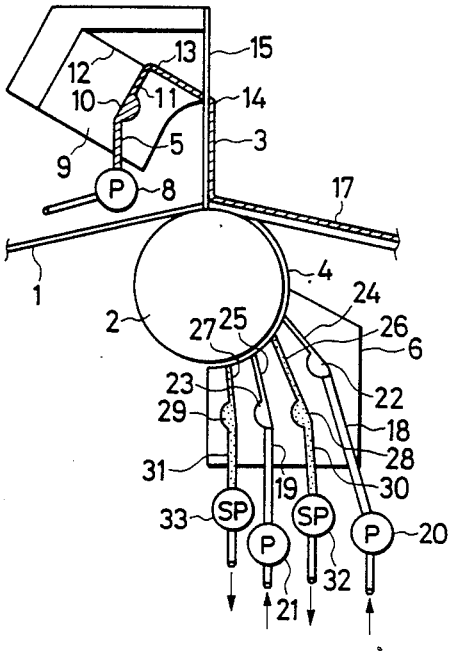
FIG. 3 is a side view thereof.

In FIGS. 1 to 3, the coating composition is fed at a fixed rate to a pocket 10 of slide hopper 9 from a tank (not shown) by a coating composition supply metering pump (P) 8. The coating composition flows through a slot 11 in the hopper 7 which extends from the pocket 10 and which has a width narrower than the pocket 10. Then, the coating composition flows over an inclined plane 12 of the slide hopper 9 in the form of a falling layer 13 to a lip 14. At the lip 14, a freely falling coating composition film 3 is formed. The freely falling coating composition film 3 is support at its edges by a pair of film-forming guide rods 15 and 16 and flows out onto the backing roll 2.

As the width W of the free falling coating composition film 3 is larger than the width w of the web 1, not only is the coating composition applied to the web 1 to form a coating film 17 on the web 1 but also the coating composition is applied to ends of the backing roll 2 to form the coating composition parts 4 and 5. The coating composition parts 4 and 5 are removed from the backing roll 2 by cleansing and suction due to the cleansing apparatus 6 and 7 provided under the backing roll 2.

Figure 4:
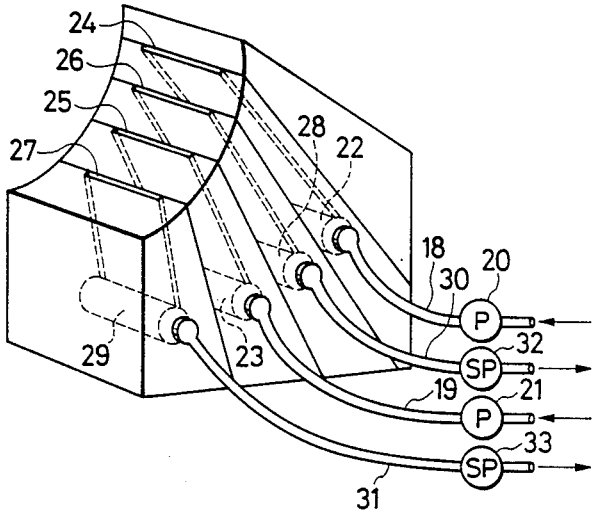
FIG. 4 is a perspective view showing the structure of the cleansing means used in the present invention.

As shown in FIGS. 3 and 4, a cleansing liquid at a uniform rate is fed at a fixed rate to pockets 22 and 23 of the cleansing apparatus 6 and 7 from a cleansing liquid tank (not shown) through pipes 18 and 19 by metering pumps 20 and 21. The cleaning liquid flows through slots 24 and 25 which extend from the pockets 22 and 23 and which are selected to be narrower than the pockets 22 and 23. Then, the cleaning liquid dilutes and cleanses the coating composition parts 4 and 5 on the backing roll 2. After the cleansing, the cleansing liquid flows into slots 26 and 27 of the cleansing apparatus 6 and 7. The cleansing liquid containing diluted liquid of the coating composition parts 4 and 5 is removed from the backing roll 2 and temporarily stays in pockets 28 and 29 of the cleaning apparatus 6 and 7. The pockets 28 and 29 are preferably wider than the slots 36 and 27. Then, the cleansing liquid is sucked by metering pumps 32 and 33 through pipes 30 and 31 so as to be returned to the cleansing liquid tank or it is discarded. The widths of the cleansing apparatus 6 and 7 should be somewhat wider than the width of the coating composition parts 4 and 5, that is, (W-L)/2.

Although the aforementioned embodiment of the present invention has shown the case where two units of cleansing liquid spray means and two units of cleansing liquid suction means are provided, the invention is not limited to the specific embodiment. For example, each of the cleansing liquid spray means and the cleansing liquid sucking means may employ a single pocket and a single slot or may employ three pockets and three slots. As another example, the pockets (or slots) of the cleansing liquid spray means may be different in number from those of the cleansing liquid suction means.

The freely falling coating composition film in accordance with the invention can be formed by a slide hopper type injector. Further, the freely falling coating composition film may be formed as a monolayer film or may be formed as a multilayer film.

Examples of the web used in the present invention include a paper web, a resin film web, a metal web, a resin-coated paper web, a synthetic paper web and the like. Typical examples of resin materials used for the resin film web are polyolefins, such as polyethlene, polypropylene and the like; polyamides, such as polyvinylacetate copolymer, 6,6-Nylon, 6-Nylon and the like; polyesters, such as polyethylene terephthalate, poyethlene-2,6-naphthalate, and the like; polycarbonates; cellulose acetates, such as cellulose triacetate, cellulose diacetate and the like; and other similar materials. Typical examples of resin materials used for the resin-coated paper web are polyolefins, such as polyethylene and the like, but the resin materials are not limited thereto. A typical examples of the metal web is an aluminum web.

According to the invention, it is preferable that the width of the freely falling coating composition film applied to the backing roll at the outer sides of the web is reduced to a minimum as long as the web can be coated with a film of a uniform thickness.

Figure 5:
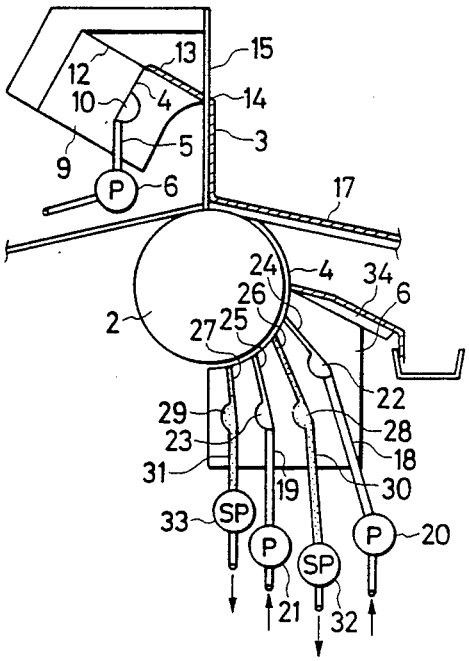
FIG. 5 is a side view showing another embodiment of the present invention.

In order to remove the coating composition applied to the backing roll in the case where the quantity of the coating composition is large, it is preferable to employ a method, shown in FIG. 5, comprising the steps of scraping the coating composition off of the backing roll by a scraper 34, spraying the cleansing liquid onto the thin coating film staying on the surface of the backing roll and of sucking the cleansing liquid containing the coating composition after cleansing. The method of FIG. 5 is expected to be more effective. As the freely falling coating composition film is applied to part of the backing roll as well as to the web, it is preferable that the surface of the backing roll is treated with Teflon (polytetrafluoroethylene) or the like in order to make it easy to remove the coating composition film from the backing roll and to thus prevent the coating composition from contacting the rear surface of the web.

The cleansing apparatus in accordance with the present invention includes both means for spraying the cleansing liquid and means for sucking the cleansing liquid containing the coating composition after cleansing. The cleansing liquid is made of diluted solution of the coating composition and additional solvent of the coating composition. The cleansing liquid spray means include pressure means (such as for example pumps), and pockets and slots for supplying a jet stream uniformly over the width of the coating composition to be removed. The sucking means include slots and pockets for uniformly sucking the cleansing liquid containing the coating composition from the aforementioned width of the coating composition to be removed, and vacuum pumps for giving sucking force to the slots and pockets.

According to the present invention, the freely falling coating composition film is larger in width than the web and is applied to the web on the backing roll which is being larger in width than the film, thus to attains a uniform coating film applied to the surface of the web without the problem that the edges of the film become thick.

In the case where the quantity of the coating composition is large, the coating composition applied to the backing roll at the outer sides of the web is scraped out of the backing roll by a scraper, such as for example a blade scraper, and then the coating composition film staying on the backing roll is removed by the cleansing means. The cleansing means comprises the cleansing liquid spray means and means for sucking the cleansing liquid containing the coating composition after cleansing. Thus, the application of the coating composition to the web can be continued without obstruction.

Accordingly, the load imposed on a dryer zone of this type coating machine can be reduced to make it possible to improve the speed, and the process of cutting the edges of the web can be omitted to improve the efficiency.

It is further to be understood that the present invention is not limited to the aforementioned embodiments but various changes and modifications may be made in the embodiments without departing from the spirit and scope of the invention. For example, it is to be understood that the cleansing means are not limited to the specific embodiments but the cleansing means may employ a united type structure or more simple structure.

What is claimed is:

1. A coating method, comprising the steps of:

continuously moving a web along a rotating backing roller;

applying a freely falling film of a coating composition to said web and to portions of said backing roller adjacent said web, the width of said film being greater than the width of said web and less than the length of said backing roller; and removing said applied film from said backing roller during operation of said moving and applying steps by providing a cleansing block in close proximity to said roller and partially surrounding said roller, wherein said removing step includes applying a cleansing liquid for sale coating composition to said backing roller at a first arcuate position on said cleansing block separated from said step of applying said film and suctioning said coating composition and said cleansing liquid from said backing roller at a second arcuate position on said cleansing block, said second arcuate position on said cleansing block being adjacent and below said first arcuate position on said block.

2. A coating method as recited in claim 1, wherein said removing step includes two of said steps of applying said cleansing liquid and two of said steps of suctioning.

3. A coating method as recited in claim 1, wherein said removing step further comprises scraping said coating composition from said backing rolls at a position intermediate positions of said two applying steps.

4. A coating apparatus, comprising:

a backing roller along which a web is moving and is continuously run;

means for forming a freely falling film of a coating composition and applying said film to said web on said backing roller, a width of said film being greater than a width of said web and less than a length of said backing roller; and cleansing means for removing said coating composition from said rotating backing roller, said cleansing means comprising at least one cleansing block disposed under said backing roller, said at least one cleansing block having an arcuate surface opposing said backing roller and a pair of slots communicating with said arcuate surface, one slot of said pair of slots supplying cleansing liquid to said coating roller and another slot of said pair of slots withdrawing said cleansing.

5. A coating apparatus as recited in claim 4, wherein said cleansing mean comprises two cleansing means disposed adjacent opposing side edges of said web moving along said backing roller.

6. A coating apparatus as recited in claim 4, further comprising a scraper for scraping said coating solution from said backing roller and disposed between said forming and applying means and said cleansing means.

7. The coating apparatus as recited in claim 4, wherein said cleansing block has another pair of slots communicating with said arcuate surface adjacent said pair of slots, one slot of said another pair supplying cleansing liquid to said coating roller and another slot of said another pair withdrawing said cleansing liquid from said coating roller by applying suction thereto, said another slot of said another pair being disposed adjacent and below said one slot of said another pair.

* * * * *

UNITED STATES PATENT AND TRADEMARK OFFICE

CERTIFICATE OF CORRECTION

PATENT NO. : 4,933,215

DATED : JUNE 12, 1990

INVENTOR(S) : YASUHITO NARUSE ET AL.

It is certified that error appears in the above-identified patent and that said Letters Patent is hereby corrected as shown below:

Title page, item [30]:

Please change Japanese Patent Application Serial No. from "184323" to --61-184323--.

Signed and Sealed this

Twenty-fifth Day of February, 1992

*Attest:*

HARRY F. MANBECK, JR.

*Attesting Officer*

*Commissioner of Patents and Trademarks*